United States Patent [19]

Adise

[11] Patent Number: 4,886,272

[45] Date of Patent: Dec. 12, 1989

[54] CARD GAME PLAYING AID

[76] Inventor: Herbert H. Adise, 65 Dickenson Pl., Great Neck, N.Y. 11023

[21] Appl. No.: 268,170

[22] Filed: Nov. 7, 1988

[51] Int. Cl.[4] ..... A63F 1/18

[52] U.S. Cl. ..... 273/148 R; 116/224

[58] Field of Search ..... 273/148 R; 116/222, 116/223, 224, 225; 434/129

[56] References Cited

U.S. PATENT DOCUMENTS

| | | | |
|---|---|---|---|
| 623,376 | 4/1899 | Landenberger | 273/148 R |
| 638,602 | 12/1899 | Shuman | 273/151 |
| 1,726,115 | 8/1929 | Mugler | 273/150 |
| 1,825,673 | 10/1931 | Latimer | 273/150 |
| 1,961,014 | 5/1934 | Skolnik | 273/150 |
| 1,989,599 | 1/1935 | Lipschitz et al. | 273/150 |
| 1,996,151 | 4/1935 | Gordon | 273/150 |
| 2,041,452 | 5/1936 | Aronberg | 273/150 |
| 4,173,342 | 11/1979 | De Corlieu-Ferran | 273/148 R |

*Primary Examiner*—Anton O. Oechsle

[57] ABSTRACT

A card game playing aid comprising a display support structure on which is affixed an array of reference marks and a plurality of legended indicators adapted to be positioned relative to said reference marks in accordance with clues and inferences of card holdings obtained during game play. The positions of the individual said indicators and the special relationships between these indicators form a compact display of key qualitative and quantitative card hand parameters determinative of card holdings, and thereby enables the user to establish the make-up of concealed card hands during game play without the need for the special skills normally required of card memorization and other mental manipulation typically beyond the capability of average card players.

5 Claims, 4 Drawing Sheets

CARD GAME PLAYING AID

BACKGROUND

1. Field of Invention

This invention relates to card games, specifically to a playing aid utilized by individual players in connection with those games involving competitive play from concealed card hands, such as Bridge, Gin Rummy and Pinochle.

2. Description of Prior Art

The ability to divine the make-up of cards held concealed in an opponent's hand during game play, known as card reading, is a skill essential for consistent winning at card games since such knowledge of card holdings prior to exposure during play provides the indispensible guide to effective play. At the present time, card reading methods require of a player highly developed personal powers of memorization and mental manipulation of individual cards and their individual circumstances of play. This is so largely because each concealed card has varying degrees of location uncertainty, all of which must be simultaneously visualized and adjusted as game play progresses.

The mental powers required for such nynamic visualizatons are typically beyond the abilities of most players. consequently the essential advantage of card reading is denied to most players.

Heretofore in the field of card games, the prior art has not been applied to remedy this denial but has been directed only towards providing the means for working out card game problems involving preset deals where all card holdings can be seen by all players; the prior art has ben used primarily as an educational tool to train players by practise to select effective strategies and tactics of game play under a given card distribution. For this purpose the means claimed in the prior art comprise game piece substitutes for real cards which are adapted for positioning on a game board in a miniature recreation of game play at a table; no means are claimed for accounting for the uncertainty of concealed card locations which are an essential ingredient of card reading. The prior art offers no workable means whereby a player could actually perform card reading during game play without the burdens of memorization.

The present invention is developed to enable the player to easily establish and display for his private use the make-up of card hands held concealed from him during an actual card game, free of memorization or other mental manipulaton. This device is based on a unique approach to card reading in which characteristic parameters of card holdings are used in the place of specific individual card identification such that a single parameter can describe multiple characteristics. Thereby a relatively few indicators can provide card reading information in a stored display already correlated for direct reading of cars held in conceald hands. The resultant device can be used with little training or skill.

OBJECTS AND ADVANTAGES

Accordingly, I claim the following as my objects and advantages of the invention:

1. To provide a card game playing aid whereby a player during an actual card game can establish and display for his private use the make-up of card hands held concealed from him, without the burden of memorization or other mental manipulation.

2. To provide a card game playing aid of the above character whch can be held concealed form other players' view in the user's hand along with his other cards.

3. To provide a card game playing aid of the above character which can be purposefully manipulated by just one finger of the user's hand.

4. To provide a card game playing aid of the above character in which the display of information can be comprehended in a momentary glance.

5. To provide a card game playing aid of the above character which can be used in many different card games, particularly Bridge, Gin Rummy and Pinochle.

6. To provide a card game playing aid of the above character which can be rapidly reset to its start position after use.

Readers will find further objects and advantages of the invention from a consideration of the ensuing description and the accompanying drawings.

DRAWING DIGURES

DRAWING REFERENCE NUMERALS

| | |
|---|---|
| 20A,B | display support structure |
| 21 | support member |
| 22 | bridging member |
| 26A,B | reference marks |
| 28A,B,C,D | indicator marker |
| 28E,F,G,H,J | indicator bead |
| 29 | magnet |
| 30A,B,C | rotational position designating marks |

DESCRIPTION OF INVENTION

Figure 1:
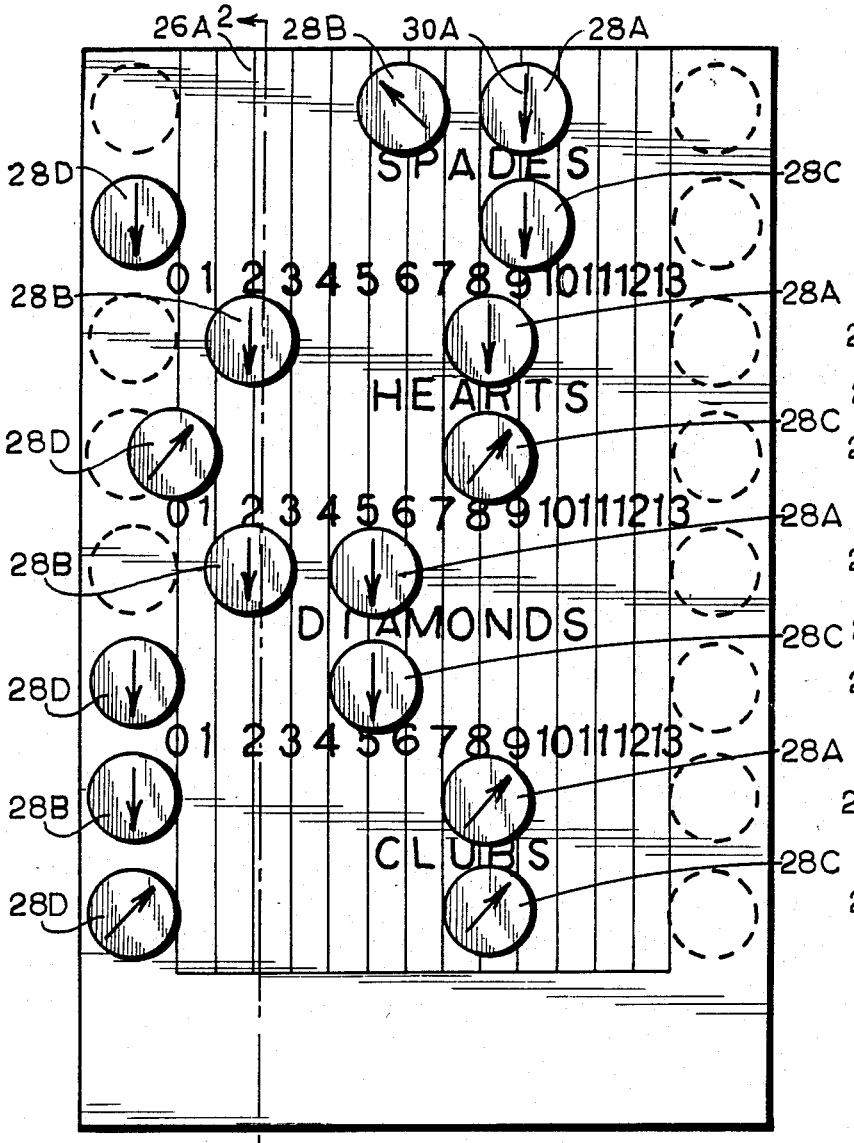
FIG. 1 shows a plan view of one embodiment of the invention as applied to the game of Bridge.
Figure 2:
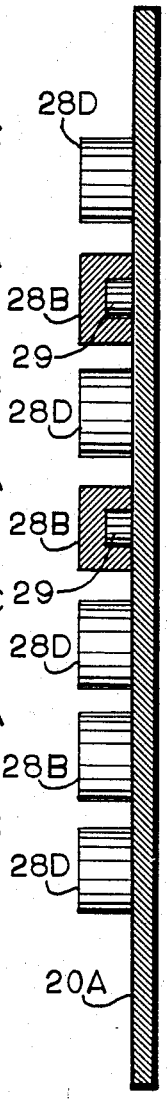
FIG. 2 shows a sectional side-view of such embodiment taken along the line 2—2 of FIG. 1.

FIG. 1 and FIG. 2 show plan and section views of one embodiment of the invention as applied to the game of Bridge, comprising a display support structure 20A of the size and shape of a standard playing carde whichis made of a magnetic material, reference means 26A consisting of fouurteen vertical numbered lines horizontally spaced equally apart and parallel affixed on one face of said display structure 20A, indicating means consisting of markers 28A,28B,28C,28D each of which incorporates a magnet 29 and a rotational position designating mark 30A in the form of an arrow pointer affixed on the exposed face of the marker. The display support structure 20A is intended to be held in the user's fingers of one hand during game play along with the standrad playing cards in a fanned array with faces exposed towards the user for his private viewing; FIG. 1 is the view the user sees when holding the invention.

The indicator markers 28A,28B,28C,28D are adapted to be positioned both laterally relative to the reference lines 26A and rotationally to positions designated by marks 30A under the urging of appropriately-applied finger-tip pressure; said markers are held in whatever position set by the magnetic attraction between the indicator markers and said display support structure.

Regarding the functioning of the embodiment shown in FIG. 1 and FIG. 2, the indicator markers 28A,28B,28C,28D are reset from their starting positions, as indicated by the broken circles in FIG. 1, to their set positions during Bridge game play wherein the translatory position setting display numerical paameters of card holdings and the rotary position setting display parameters of court card holdings. These position settings are performed by the user in accordance with the following table:

TABLE I

| Marker | Position | Display |
|---|---|---|
| 28A | (1) Left side tangent to numbered line 26A | Number of suit cards in both concealed hands before trick play; denotes Ace court card. |
| 28B | (2) Right side tangent to numbered line 26A | Number of suit cards likely or actually in left concealed hand before trick play; also denotes King court card. |
| 28C | (3) First to Position (1), then moved one line left with each card discarded from right concealed hand. | Cards discarded from right concealed hand during trick play; denotes Queen court card. |
| 28A, 28C | Position (1) minus Position (3) | Number of suit cards discarded from right concealed hand during trick play. |
| 28D | (4) Right side tangent to numbered line 26A | Number of suit cards discarded from left concealed hand during trick play; Jack court card. |
| 28A, 28B | Position (1) minus Position (2) | Number of suit cards likely or actually in right concealed hand before trick play. |
| 28B, 28D | Position (2) minus Position (4) | Number of suit cards likely or actually in left concealed hand at any time. |
| 28C, 28B | Position (3) minus Position (2) | Number of suit cards likely or actually in right concealed hand at any time. |
| 28A, 28B | Markers touching. | Right concealed hand void in suit before trick play. |
| 28C, 28D | Markers touching. | Both concealed hands void in suit after trick play. |
| All | (5) Pointer 30A vertical upward, parallel to line 26A (12 o'clock) | Court card in either one of the two concealed hands. |
| All | (6) Pointer canted 45 degrees to right of Position (5) 1:30 o'clock) | Court card likely in right concealed hand. |
| All | (7) Pointer canted 90 degrees to right of Position (5) perpendicular to line 26A (3 o'clock). | Court card confirmed in right concealed hand. |
| All | (8) Pointer canted 45 degrees to left of Position (5) (10:30 o'clock) | Court card likely in left concealed hand. |
| All | (9) Pointer canted 90 degrees to Left of Position (5) perpendicular to line 26A (9 o'clock). | Court card confirmed in left concealed hand. |
| All | (10) Pointer vertical downward (6 o'clock) | Court card not in either concealed hand. |

The invention can be used for card reading by any player in the game. In Bridge, it can be used by either the declarer or any defender. In this respect, the conventions regarding which concealed hand constitutes the left or right one relative to the user are as follows: (1) for the player sitting South (S), the left concealed hand is West (W) and the right is East (E). (2) for the West (W) player, the right concealed hand is South (S) and the left is East (E). (3) for the East (E) player, the left concealed hand is South (S) and the right is West (W).

These conventions are sued in the play of the Bridge game as follows: (1) After the bidding phase of the game has been completed and the lead card has been exposed by the player to the left of the declarer, and when the dummy's cards are exposed, each player sees at least twenty six of the fifty two cards—the thirteen in his and and the thirteen in the dummy's hand; the two players other than the lead card player see the lead card in addition. The use of my invention can immediately position indicator markers 28A for each suit (displaying the total number of cards in each suit in both concealed hands) by subtracting from thirteen the sum of the number of suit cards in his and the dummy's hands, and then laterally positioning indicator marker 28A at the difference number line for each suit. (2) Again by inspection of his and the dummy's hands, the user can determine those court cards not seen, therefore in both concealed hands, and so he can rotationally position the indicator markers 28A,28B,28C,28D accordingly. (3) From the clues as to card holdings offered by the invention user's review of the bidding, his sight of the lead card, and the inferences regarding card holdings that the bids (or lack of bids) imply which are well known to Bridge players, the user can position indicator markers 28A,28B,28C,28D to display the likely distribution of the card count and court cards held in each of the two concealed hands. (4) Once play begins and discards from concealed hands appear, the positions of the various indicator markers are altered by the user in accordance with the above conventions, creating an ever-clearer display of the contents of the concealed hands so that play strategy can be executed for maximum effectiveness.

The set indicator marker positions shown in FIG. 1 display the make-up of the two concealed card hand in an actual Bridge game at the point in the game where the declarer sitting South (S) is the invention user, receiving a lead of a Heart spot card from West (W) to his left, and the bidding sequence has been (E) 3 Clubs (S) 3 Diamonds, (W) 3 Spades, (N) 4 Hearts, (E) Double, (S) 5 Diamonds, (W) Pass, (N) 6 Diamonds, all Pass; declarer (S) hand being in Spades: Ace, Queen,x, in Hearts: none, in Diamonds: King, Queen, Jack, x,x,x,x and in Clubs: King,x,x, and the dummy (N) hand being in Spades:Jack,x, in Hearts:Ace, King,x,x,x,x, in Diamonds: Ace,x, and in Clubs:x,x,x. The total card count indicator marker 28A positions are set by the declarer using this information.

In the face of (E) opening bid of 3 Clubs, his partner's(W) lead of a Heart card implies no Clubs in the (W) hand, and therefore the indicator marker 28B for Clubs is left positioned at the zero number refernce line for the left (W) concealed hand, thereby displaying that seven Club cards are being held in the right (E) concealed hand; the missing Ace, Queen and Jack of Clubs are therefore marked as being in the right concealed hand so the user sets the Club indicator markers 28A, 28B, 28C, 28D in rotation accordingly.

The bid by (W) of 3 Spades over the declarer's(S) strong bid indicates a holding of at least seven Spade cards likely headed by the missing King, and therefore one Spade in the right(E) concealed hand; the indicator marker 28B in Spades is then positioned by the user accordingly.

The Double bid by the right concealed hand (E) over the dummy (N) bid of 4 Hearts suggest that the two missing Heart court cards are likely in the right concealed hand along with not more than two other Heart cards (if he had more than four Hearts headed by the Queen,Jack the (E) bidder would have likely opened the bidding at 1 Heart rather than 3 Clubs). Thus with the right concealed hand marked with four Hearts, the left closed hand would likely have three Hearts.

The seven Spades coupled with a Club void in the left (W) concealed hand leaves just six cards in Hearts and Diamonds possible in the left concealed hand, and with the three Heart cards already determined to likely be in the left concealed hand, it is therefore likely to hold just three Diamonds.

The make-up of cards held in the concealed hand to the left of the invention user is thus likely to be seven Spades headed by the King three Hearts, three Diamonds, Club void, and in the right concealed hand one Spade, four hearts headed by the Queen and Jack, one Diamond, seven Clubs headed by the Ace, Queen and Jack. All this information is displayed to the invention user as shown in FIG. 1, by means of just sixteen spatially-oriented indicators of characteristic card-holding parameters which can be absorbed in a single glance, and which place no burden on memory.

Once play begins and discards from concealed hands appear, the positions of the various indicator markers are altered by the user in accordance with the conventions above, creating an ever-clearer display of the contents of the concealed hands so that play strategy can be executed for maximum effectiveness.

This particular deal is for illustration because it facilitates the description of the invention. In many real game situations, bidding may be less competitive and fewer clues to card holdings may be available. Under these circumstances the use would position the indicator markers to tentative settings and alter these settings as play progresses. It is also to be understood that the invention could be used as well to advantage by the defending players in the illustrated deal to guide the execution of the most advantageous plays for the defenders.

Figure 3:
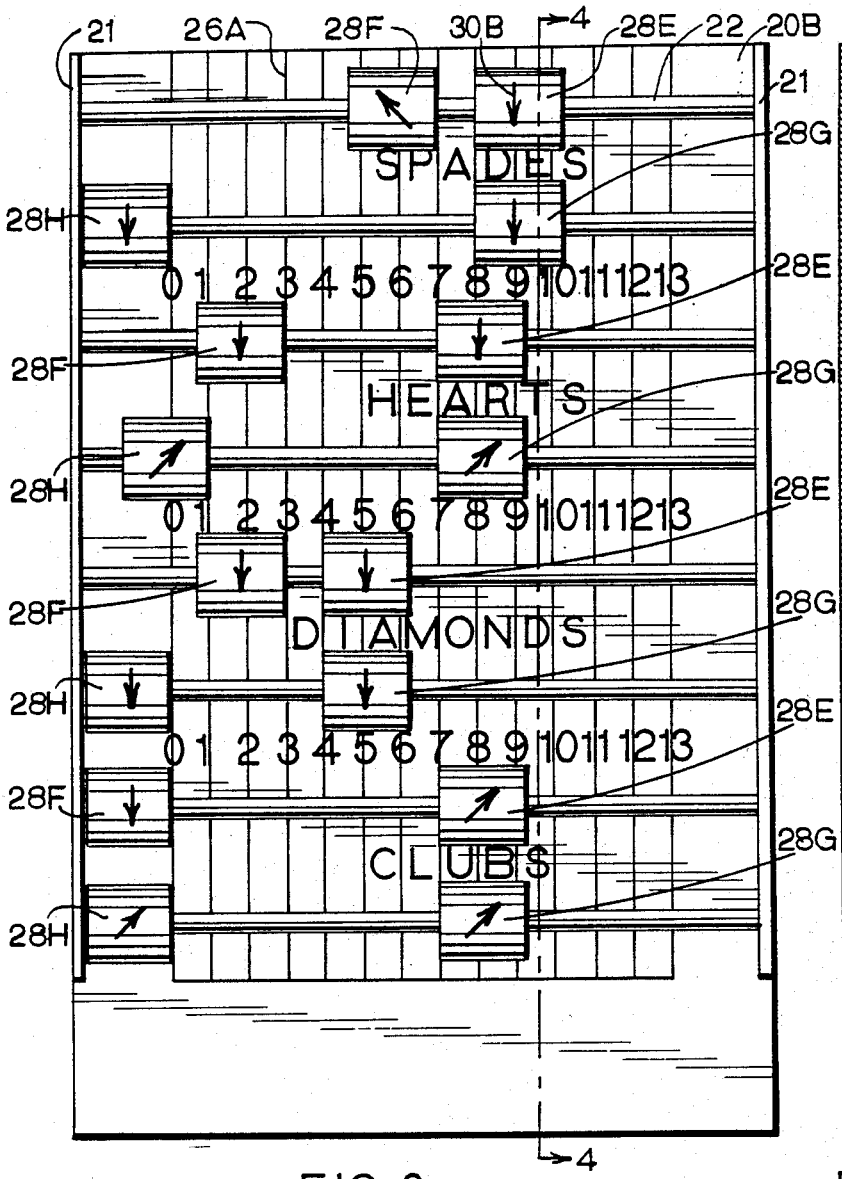
FIG. 3 shows a plan view of the preferred embodiment of the invention as applied to the game of Bridge.
Figure 4:
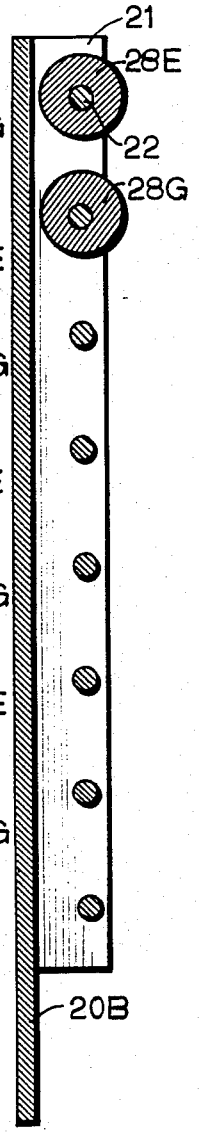
FIG. 4 shows a sectional side-view of such embodiment taken along the line 4—4 of FIG. 3.
Figure 5:
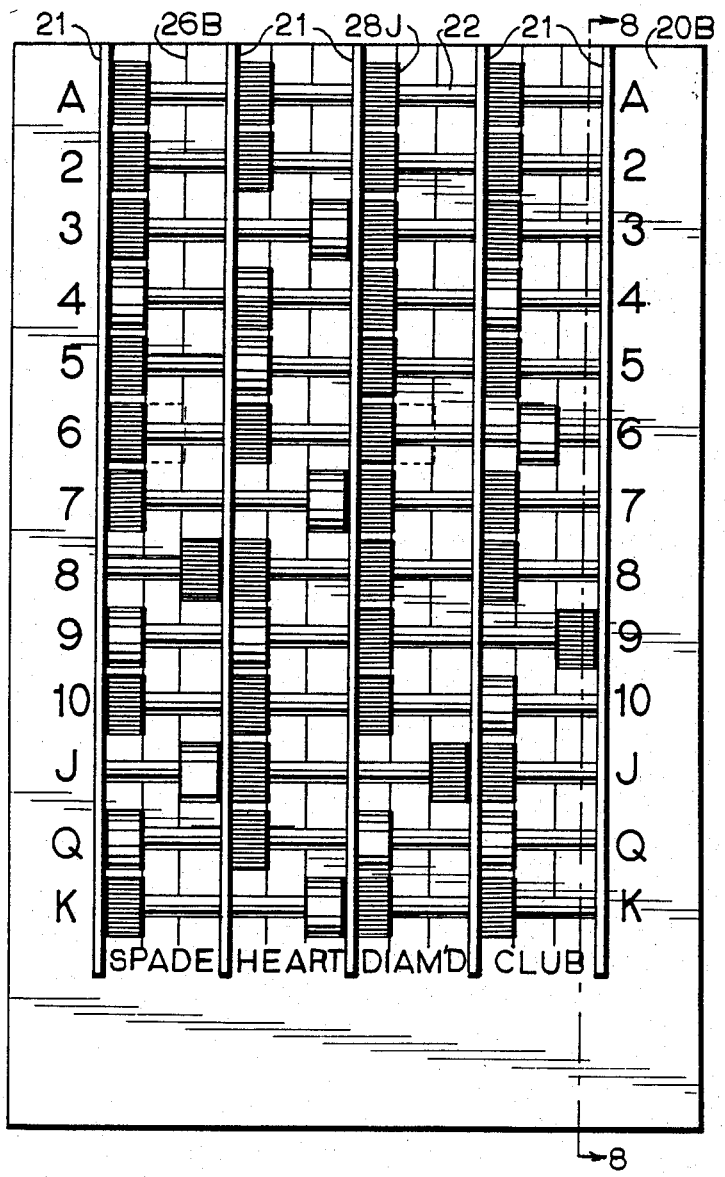
FIG. 5 shows a plan view of the preferred embodiment of the invention as applied to the game of Gin Rummy.
Figure 6:
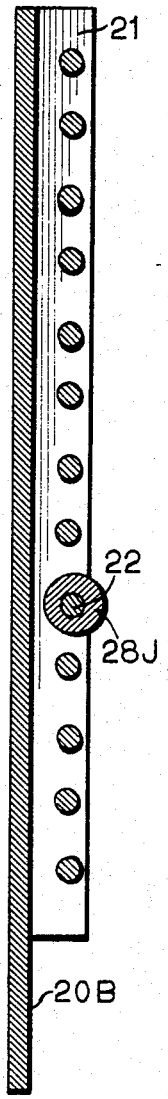
FIG. 6 shows a sectional side-view of such embodiment taken along the line 8—8 of FIG. 7.
Figure 7:
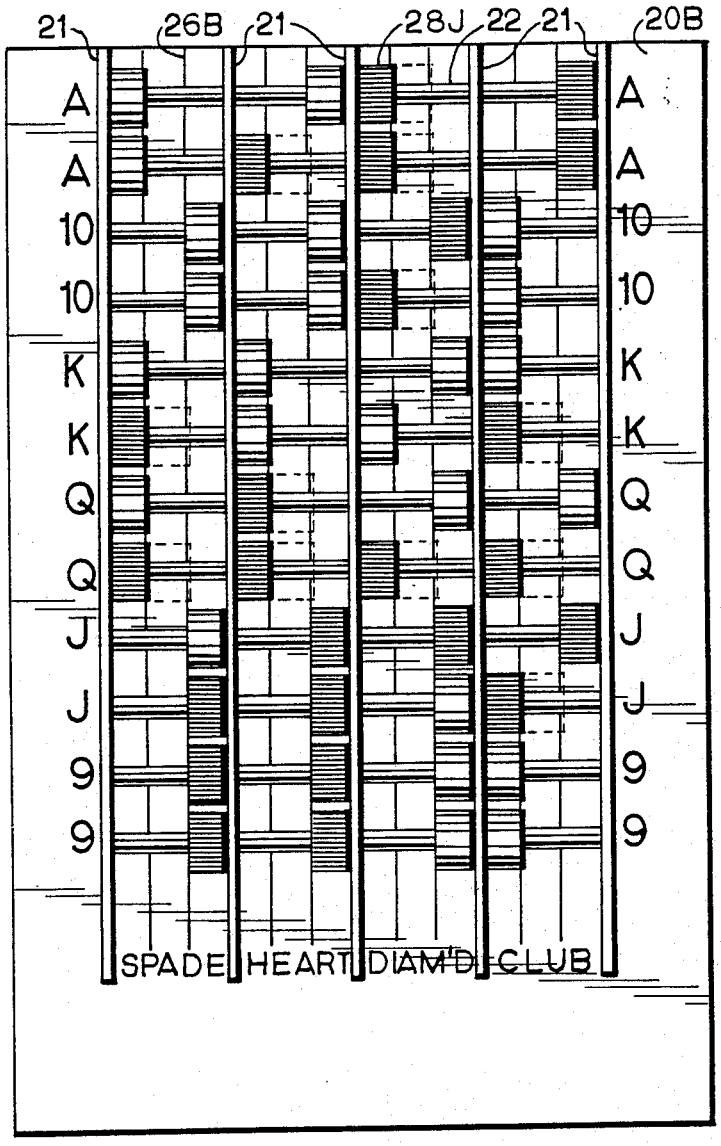
FIG. 7 shows a plan view of the preferred embodiment of the invention as applied to the game of two-handed Pinochle.

The preferred embodiment of the invention as applied to the game of Bridge is shown in FIG. 3 and FIG. 4, as applied to the game of Gin Rummy is shown in FIG. 5, FIG. 6, and as applied to Pinochle is shown in FIG. 7. The preferred embodiment utilizes cylindrical indicator beads secured to the display support structure in place of the loose indicator markers shown in FIG. 1 and FIG. 2.

This embodiment as applied to the game of Bridge comprises a display support structure 20B of the size and shape of a standard playing card, having reference lines 26A affixed on one face, support members 21 extending from said face, bridging members 22 connecting support members 21 and spaced apart in parallel from each other and from said face of the display support structure 20A, cylindrical indicator beads 28E, 28F,28G,28H free to move n translation and rotation on said bridging members 22, each said indicator bead having the same rotational position designating marks 30B appearing as a series of pointers in different positions and equally spaced along its peripheral surface.

The indicator beads 28E,28F,28G,28H are adapted to be positioned both laterally relative to said reference lines 26A and rotationally set to positions designated by rotational position marks 30B, under the urging of applied finger-tip pressure.

For the purposes of displaying the characteristic parameters of the concealed card hands, indicator beads 28E,28F,28G,28H are positioned in respective accordance with indicator markers 28A, 28B,28C,28D as described in connection with the prior embodiment shown in FIG. 1 and FIG. 2. In all other respects the preferred embodiment shown in FIG. 3 and FIG. 4, functions for the purpose of establishing and displaying the make-up of concealed card hands exactly as described above with respect to the embodiment shown in FIG. 1 and FIG. 2. THe display of the indicator beads shown in FIG. 3 corresponds to the indicator marker display shown in FIG. 1.

The preferred embodiment of the invention as applied to the game of Gin Rummy as shown in FIG. 5, and FIG. 6, comprises a display supporr structure 20B of the size and shape of a standard playing card, reference means consisting of eight vertical lines 26B spaced equally apart and parallel on one face of said display support structure 20B, support members 231 extending from the face of said display support structure 20B, bridging members 22 connecting said support members 21 and spaced apart in parallel from each other and from the face of the display support structure 20B, cylindrical indicator beads 28J free to move in rotation and translation on said bridging members 22, said indicator beads 28J having rotational position designating marks 30C appearing as two equal areas of contrasting colors (blue and white) appearing on the peripheral surface of the indicator bead 28J.

The indicator beads 28J are adapted to be positioned both laterally relative to said reference lines 26B between adjacent pairs of said support members 21, and rotationally set to positions designated by the rotational position marks 30C, both of which are employed to represent the status and history of playof a particular card, and enable card reading without memorization or other mental manipulation.

Regarding the functioning of this embodiment of the invention, each indicator bead shown in FIG. 5 is initially set in the left-most position against its respective support member 21 by the light sweep of a finger over all beads, and rotationally set to where the black color position mark 30C is exposed to view. Thereafter during the play of the game, these initial bead settings are reset according to the conventions shown in Table II below.

FIG. 5 shows the indicator bead settings following these conventions at an early stage in a typical Gin Rummy game. As displayed in the left-most bead settings in each suit, live in the user's hand are the Spade four,nine and Queen, the Heart four (retrieved from the opponent's discard), five and nine, the Diamond Queen, and the Club fourn, ten and Queen; the other live cards displayed are either in the opponent's hand or the stock pile. As displayed in the right-most indicator bead settings in each suit, the user has discarded the Spade Jack, the Heart three, seven and King, all of which the opponent refused to retrieve, and the opponent has discarded the Spade eight, the Heart four (which was retrieved by the user), the Diamond Jack and the Club nine. As displayed in the midway lateral indicator bad setting in each suit, the opponent is known to hold the Club six which was retrieved from a user discard.

TABLE II

| Position | Bead Color | Display |
|---|---|---|
| (1) Left-most against adjacent support member 21 | Black | Card alive, either in stock pile or opponent's hand. |
| (1) | White | Card alive, in user's hand. |
| (1) | Top Black, Bottom White | Card alive, in user's hand after retrieval from opponent's discard. |
| (1) | Top White, Bottom Black | Card alive, in user's hand after original discard by user, opponent retrieval, opponent discard and user retrieval. |
| (2) Right most against adjacent support member 21 | Black | Card dead after discard by opponent and non-retrieval by user. |
| (2) | White | Card dead after discard by user and non-retrieval by opponent. |
| (2) | Top Black, Bottom White | Card dead after original discard by opponent, user retrieval, user discard, opponent non-retrieval |
| (2) | Top White, Bottom Black | Card dead after original discard by user, opponent retrieval, opponent discard, user non-retrieval. |
| (3) Midway between adjacent support members 21 | Black | Card likely or actually in opponent's hand. |
| (3) | White | Card in opponent's hand after retrieval from user discard. |
| (3) | Top Black, Bottom White | Card in opponent's hand, original discard by opponent, user retrieval, user discard, opponent retrieval. |

With this history of card playso obviously displayed that it can be taken in at a glance, the invention user can guide his future play at any time during the game to assist him in the win. For example, if at his next draw from the stock pile the user picks a Heart six which obviously does not fit into his hand, before discarding it he must determine whether it is a safe discard which cannot benefit his opponent. By reference to the playing aid, the invention user can see that his opponent has refused to retrieve the Heart three and seven when discarded by the user and had himself discarded the Heart four and retrieved the Club six. Obviously the opponent could have no use for the Heart six to complete a Heart run meld, but could likely use the Heart six to meld with the Club six and likely other six-spot card holdings. From such card reading made possible by the invention, the user knows he must retain the Heart six and can safely discard the Heart five from his hand. No card memorization is required to read the opponent's cards.

In order to memorialize the opponents like six-spot card meld, the user can move the six-card indicators 28J in Spades and Diamonds from their positions against the left support member 21 shown in FIG. 5 over to the midway position shown in the broken lines in FIG. 5, but still showing the black color. With this display before him, the user can be reminded to retain the Heart six both to deny his opponent a possible game-winning extension of his likely six-spot card meld and as a possible lay-off card in the event his opponent knocks.

The preferred embodiment of the invention as applied to the game of two-handed Pinochle is shown in FIG. 7, and differs in structure from that shown in FIG. 5 for Gin Rummy only in that fewer bridging members 22 and fewer indicator beads 28J are used. The conventions employed for positioning the indicator beads 28J and the functioning of this embodiment are exactly the same as in the Gin Rummy equivalent.

The history of Pinochle card play after the twelfth trick has been played (twenty four cards now out of play) is shown in FIG. 7. The user has been keeping track of the discards during trick play and can see from the display shown in FIG. 7 that the opponent's card holdings are likely to be the Spade King and Queen, the Heart Ace, Queen and Queen, the Diamond Ace, Ace, Ten and Queen and the Club King, Queen and Jack; the user's holdings are also shown as the Spade Ace, Ace, King and Queen, the Heart King and King, the Diamond King and the Club Ten, Ten, King, Nine and Nine. At this point the invention user may shift the indicator beads 28J denoting the opponent's card holdings from their left-most positior shown in FIG. 7 to the midway position shown by the broken liens in FIG. 7, as a more direct display of the opponent's concealed card holdings.

The invention user now sees that he controls trick play in the Spade and Club suits whereas the opponent controls trick play in the Diamond and Heart suits, and he can plan his play for the last twelve tricks for the most advantage.

CONCLUSION AND SCOPE OF INVENTION

Thus the reader can see that the card game playing aid of this invention provides a simple but powerful device which can be used by average card game players to easily establish and display the make-up of card hands held concealed from them by other players, as a guide to more effective play strategy.

While the above description contains many specificities these should not be construed as limitations on the scope of the invention, but merely as exemplifications of various embodiments thereof. Those skilled in the art will envision many other possible variations within its scope. For example, skilled artisans will readily be able to change the dimensions and shape of the various embodiments and use alternate reference means and locations; they can make many variations in the shape of parts, using non-circular shapes and cross-sections. Multiple independent dials con be combined into groupings of concentric dials, or mechanical counters can be substituted for dials. Stops, detents, stepper links and other like mechanical variations can be incorporated to assist in indicator positioning. The electronic embodiment can be made to utilize self-storing displays, or alternative display generation circuitry and control means, or multiplexing means for circuit sharing; a reset-to-start display circuit or automatic turn-off circuit may also be incorporated. Accordingly the reader is requested to determine the scope of the invention by the appended claims and their legal equivalents, and not by the examples which have been given.

I claim:

1. A card game playing aid which stores and displays characteristic parameters of playing card hands including the total number of cards held in each suit, the ranked cards held in each suit, the spot cards held in each suit, the cards which have been discarded during play and their source, the discarded cards which have been retrieved during play and their destination, and the source and destination history of discard and retrieval of individual cards, comprising:

a display support structure, means for reference affixed to said display support structure, indicating means denoting characteristic parameters of card holdings, adapted to be positioned on the display support structure in cooperative alignment with said reference means, where said position settings are determined by factors including the number of cards and the individual ranked cards in each suit which are exposed at the start of play, the numbers, ranking and source of suit cards exposed during play, the inferences obtained prior to the start of play regarding numbers, rank and location of concealed suit cards, the inferences obtained during play regarding the number, rank and location of concealed suit cards, and the number, ranking, source and destination of individual suit cards exposed during play, means for displaying the position of said indicating means, whereby a card game player can establish and have displayed the make-up of card hands held concealed from his view by other players, without the need for card memorization or other mental visualization.

2. The card game playing aid as recited in claim 1 wherein said display support structure is a planar member, said reference means is a plurality of spaced lines affixed on one face of said planar member, said indicating means is a plurality of markers adapted for positioning on said face of the planar member relative to said lines, said markers incorporate a means for designating the rotational position of the markers relative to the lines.

3. The card game playing aid as recited in claim 1 wherein said display support structure is a planar member, said reference means is a plurality of spaced lines affixed on one face of said planar member, a plurality of support members project from said face, a plurality of bridging members connect said support members, said indicating means is a plurality of beads threaded onto said bridging members and adapted to move in translation and rotation on said bridging members to positions relative to said lines, said beads incorporate a means for designating the rotational position of the beads relative to the lines.

4. The card game playing aid as recited in claim 1 wherein said display support structure is a planar member, said reference means is a plurality of index marks affixed on one face of said planar member, said indicating means is a plurality of dials adapted for positioning on said face of the planar member relative to said index marks, said dials incorporate a means for designating the rotational position of the dials relative to the index marks.

5. A card game playing aid which stores and displays characteristic parameters of playing card hands including the total number of cards held in each suit, the ranked cards held in each suit, the spot cards held in each suit, the cards which have been discarded during play and their source, the discarded cards which have been retrieved during play and their destination, and the source and destination history of discard and retrieval of individual cards, comprising:

a display support structure, means for reference affixed to said display support structure, indicating means for displaying characteristic parameters of card holdings, located in adjacent relation to said reference means, means for generating said indicator displays where the data displayed are determined by factors including the number of cards and the individual ranked cards in each suit which are exposed at the start of play, the numbers, ranking and source of suit cards exposed during play, the inferences obtained prior to the start of play regarding numbers, rank and location of concealed suit cards, the inferences obtained during play regarding the number, rank and location of concealed suit cards, and the number, ranking, source and destination of individual suit cards exposed during play, whereby a card game player can establish and have displayed the make-up of card hands held concealed from his view by other players, without the need for card memorization or other mental visualization.

* * * * *

UNITED STATES PATENT AND TRADEMARK OFFICE

CERTIFICATE OF CORRECTION

PATENT NO. : 4,886,272

DATED : December 12, 1989

INVENTOR(S) : Herbert H. Adise

It is certified that error appears in the above-identified patent and that said Letters Patent is hereby corrected as shown below:

Col.1,line 26, change "nynamic" to--dynamic--

Lol.2,lines 56 and 57, change "carde whichis" to --card which is--

Col.4,line 9, change "sued" to --used--

Col.4,line 17, change "use" to--user--

Col.5, line 22, insert comma after word "King"

Col.5, line 41, change "use" to--user--

Col.6, line 16, change "THe" to--The--

Col.6, line 21, change "supporr" to--support--

Col.6, line 25, change "231" to--21--

Col.6, line 41, change "playof" to--play of--

Col.6, line 59, change "fourn" to--four--

Col.8, line 35, insert comma after "specificities"

Signed and Sealed this

Twenty-third Day of October, 1990

*Attest:*

HARRY F. MANBECK, JR.

*Attesting Officer*

*Commissioner of Patents and Trademarks*